US005679280A

United States Patent [19]

Sasaki et al.

[11] Patent Number: 5,679,280

[45] Date of Patent: Oct. 21, 1997

[54] ELECTRO RHEOLOGICAL FLUID

[75] Inventors: Makoto Sasaki; Takafumi Ishii; Katsuhiko Haji, all of Yokohama, Japan

[73] Assignee: Nippon Oil Co., Ltd., Tokyo, Japan

[21] Appl. No.: 570,198

[22] Filed: Dec. 11, 1995

Related U.S. Application Data

[63] Continuation of Ser. No. 246,727, May 20, 1994, abandoned.

[30] Foreign Application Priority Data

May 21, 1993 [JP] Japan ..... 5-141253
Jun. 8, 1993 [JP] Japan ..... 5-163308

[51] Int. Cl.[6] ..... C10M 171/00; C10M 169/04

[52] U.S. Cl. ..... 252/77; 252/73; 252/79; 252/572

[58] Field of Search ..... 252/73, 77, 79, 252/572

[56] References Cited

U.S. PATENT DOCUMENTS

| | | | |
|---|---|---|---|
| 3,047,507 | 7/1962 | Winslow | 252/75 |
| 4,420,647 | 12/1983 | Hammond et al. | 585/10 |
| 5,354,489 | 10/1994 | Inoue et al. | 252/73 |
| 5,536,428 | 7/1996 | Sasaki et al. | 252/77 |
| 5,562,864 | 10/1996 | Salomon et al. | 508/232 |

FOREIGN PATENT DOCUMENTS

| | | | |
|---|---|---|---|
| 391649 | 10/1990 | European Pat. Off. . | |
| 0478034 | 4/1992 | European Pat. Off. | C10M 171/00 |
| 0579229 | 1/1994 | European Pat. Off. . | |
| 609623 | 8/1994 | European Pat. Off. . | |
| 63-159491 | 7/1988 | Japan . | |
| 4-348194 | 12/1992 | Japan . | |
| 93 23505 | 11/1993 | WIPO . | |

*Primary Examiner*—Christine Skane
*Attorney, Agent, or Firm*—Ostrolenk, Faber, Gerb & Soffen, LLP

[57] ABSTRACT

A homogeneous electro rheological fluid of the invention comprises a poly(α-amino acid) or a poly(γ-glutamate), and an electric insulating liquid in a specific amount to. To provide a homogeneous electro rheological fluid of good stability, with long lasting and consistent performance in the presence of a trace of water. The fluid also exerts a good electro rheological effect wherein a hydrocarbon oil or an ester-type oil is used as an electric insulating liquid.

14 Claims, No Drawings

ELECTRO RHEOLOGICAL FLUID

This is a Continuation of Application Ser. No. 08/246,727 filed on May 20, 1994, now abandoned

BACKGROUND OF THE INVENTION

1. Field of the Invention

The present invention relates to an electro rheological fluid, and to a homogeneous electro rheological fluid in particular, wherein the viscosity of the fluid can be controlled by applying an electric field.

2. Background Art

An electro theological fluid is generally referred to as an electric insulating fluid in which inorganic or high-molecular particles have been dispersed in a state of suspension. The viscosity of the fluid varies rapidly and reversibly from a liquid to a plastic solid state when an electric field is applied to the fluid. The phenomenon is referred to as the Wien's law effect.

Generally, the surface of the foregoing dispersed particles is affected and polarized with ease by the action of an electric field. Examples of the inorganic dispersion particles include silica, (U.S. Pat. No. 3,047,507, BP No. 1,076,754 and JP Laid-Open Publication No. 61-44998) and zeolite (JP Laid-Open Publication No. 62-95397). Examples of the high-molecular dispersion particles include an alginic acid (JP Laid-Open Publication No. 51-33783), a glucose having carboxyl or sulfonic acid group, a divinylbenzene-crosslinked polyacrylic acid (JP Laid-Open Publication No. 53-93186), and a resol-type phenolic resin (JP Laid-Open Publication No. 58-179259).

Examples of the electric insulating liquid include a hydrocarbon oil, a silicone oil, an ester-type oil, and a fluorine-type oil, and the like. Although it is envisaged that the prime application of electro rheological fluids will be in the production of engine mounts, shock absorbers, clutches, and the like, they have not been put to practical use.

Precipitation of the dispersed particles from the heterogeneous phase of electro rheological fluids is the main difficulty. Attempts to develop homogeneous electro theological fluids have been made, for example, by using a low-molecular liquid crystal such as methoxybenzylidene butylaniline [Japanese Journal of Applied Physics 17, page 1525(1978)]; however, the resulting fluids have a very poor electro rheological effect, and have not been commercially acceptable. In addition to the foregoing, Japanese Patent Publication No. 42-11315 discloses a homogeneous solution of a high-molecular liquid crystal which can exert an electro rheological effect.

Further, it has been disclosed that a solution of a poly(γ-benzyl-L-glutamate) in a low-boiling polar solvent or a low-boiling chlorine-type solvent can exert a marked electro rheological effect wherein dioxane, tetrahydrofuran, and cresols, or the like is used as the polar solvent, and methylene chloride, chloroform, or the like is used as the chlorine-type solvent [(JP Laid-Open Publication Nos. 4-191511, 4-266997, and preparatory notes for the 16th forum on liquid crystal, page 82 (1990)]. The poly(γ-butyl-L-glutamate) is well known as a lyotropic liquid crystal.

Although the homogeneous electro rheological fluids prepared from a poly(γ-benzyl-L-glutamate) exert a good electro rheological effect and can circumvent the problem of precipitation of the dispersed particles, they are poor in stability and difficult to put to practical use; therefore they have not been commercially acceptable. The reason is that the ester groups located on side chains of the polymer structure are hydrolyzed with ease in the presence of a trace of water, thereby causing displacement of the ester groups by carbonyl groups. This triggers the cleavage of the main chain thereby deteriorating the quality of the fluid. In addition, the solvent for poly(γ-benzyl-L-glutamate) is limited to low-boiling polar solvent or chlorine-type solvents; therefore, the resulting electro rheological fluids have problems associated with the corrosion of electrodes, poor current insulation, and volatility and strong toxicity of the solvent.

SUMMARY OF THE INVENTION

It is an object of the present invention to provide an electro rheological fluid of good stability, and to provide a homogeneous electro rheological fluid in particular, .wherein the performance of the electro rheological fluid lasts long even in the presence of a trace of water.

It is another object of the invention to provide a homogeneous electro theological fluid which exerts a good electro rheological effect, wherein a solvent such as hydrocarbon oils or ester-type oils is used as the insulating liquid.

The inventors of the invention have intensively investigated to solve the problems as described above, and have found that the objects of the present invention can be attained by dissolving a specific high-molecular liquid crystal in a solvent used as the insulating liquid of an electro rheological fluid.

According to the invention, an electro rheological fluid can be provided wherein the electro rheological fluid comprises 40 to 99.9% by weight of a solvent and 0.1 to 60% by weight of a poly(α-amino acid) represented by the following formula (I):

$$-(NH-\underset{}{\overset{R}{\overset{|}{CH}}}-CO)_m- \quad (I)$$

wherein R has from 1 to 30 carbon atoms and is an alkyl, aralkyl, aryl, cycloalkyl, or mixed groups thereof, and m is a degree of polymerization from 5 to 10,000.

Furthermore, according to the present invention, an electro theological fluid can also be provided wherein the electro rheological fluid comprises 40 to 99.9% by weight of an electric insulating liquid and 0.1 to 60% by weight of a poly(γ-glutamate) represented by the following formulas (II) and (III):

$$-(NH-\underset{C_2H_4-COO-R_1}{\overset{|}{CH}}-CO)_m- \quad (II)$$

$$-(NH-\underset{C_2H_4-COO-R_2}{\overset{|}{CH}}-CO)_n- \quad (III)$$

wherein $R_1$ has from 1 to 7 carbon atoms and is an alkyl, aralkyl, aryl, cycloalkyl, or mixed groups thereof, $R_2$ has from 8 to 30 carbon atoms and is alkyl, aralkyl, aryl, cycloaklyl, or mixed groups thereof, and the ratio of n to m, i.e. (n/m) is from 100/0 to 10/90.

DETAILED DESCRIPTION OF THE PREFERRED EMBODIMENTS

Examples of the R in poly(α-amino acid) represented by the formula (I) include an alkyl group such as methyl, ethyl, propyl, butyl, pentyl, hexyl, octyl, nonyl, decyl, dodecyl, tetradecyl, hexadecyl, or oleyl group; an aryl group such as phenyl or butylphenyl group; an aralkyl group such as benzyl or butylbenzyl group; a cycloalkyl group such as cyclohexyl or butylcyclohexyl group. R may be the same or different in one polymer structure. R has preferably from 6 to 16 carbon atoms and is preferably an alkyl, aralkyl, aryl, or cycloalkyl group, and more preferably an octyl, decyl, dodecyl, tetradecyl, or hexadecyl group which has a good solubility in hydrocarbon oils or ester-type oils used as a suitable solvent for preparing electro rheological fluids.

Poly(γ-glutamate) of the present invention is represented by the formulas (II) and (III). Examples of the $R_1$ in the formula (II) include an alkyl group such as methyl, ethyl, propyl, pentyl, or hexyl group; an aryl group such as phenyl group; an aralkyl group such as benzyl group; and a cycloalkyl group. $R_1$ is preferably a methyl or benzyl group. $R_1$ may be the same or different in one polymer structure.

Examples of the $R_2$ in the formula (III) include an alkyl group such as octyl, nonyl, decyl, dodecyl, or oleyl group; an aralkyl group such as butylbenzyl group; an aryl group such as butylphenyl group; and a cycloalkyl group such as butylcyclohexyl group. $R_2$ is preferably an octyl, decyl, dodecyl, oleyl, or butylhexyl group, more preferably a dodecyl or oleyl group which has a good solubility-improving effect. $R_2$ may be the same or different in one polymer structure.

$R_2$ plays an important role in making the poly(γ-glutamate) soluble in a hydrocarbon oil or an ester-type oil. When the carbon number of $R_2$ is less than 8, the solubility of poly(γ-glutamate) in a hydrocarbon oil or an ester-type oil is not sufficient, and inversely when the carbon number is more than 30, it becomes hard to synthesize.

The ratio of components (III) to (II) e.g. (n/m) is from 100/0 to 10/90, preferably 80/20 to 30/70. When the ratio is less than 10/90, the solubility of poly(γ-glutamate) in a hydrocarbon oil or an ester-type oil is not sufficient.

The sequence of the monomeric moiety represented by the formulas (II) and (III) may be alternating, block or random, preferably alternating or random.

The degree of the polymerization is from 5 to 10,000, preferably 10 to 5000. When the degree is less than 5, the electro rheological effect is not sufficient, and inversely when the degree is more than 10,000, the solubility decreases. The molecular weight is preferably from 500 to 1,000,000, more preferably 2000 to 500,000. When the molecular weight is less than 500, the electro rheological effect is not sufficient, and inversely when it is more than 1,000,000, the solubility in oil decreases.

The poly(α-amino acid) represented by the formula (I) can be prepared via N-carboxylic acid anhydride from the corresponding α-amino acid in the presence of phosgene by NCA polymerization.

The poly(γ-glutamate) represented by the formulas (II) and (III) can be prepared from poly(γ-glutamate) having only an $R_1$ group by ester exchange reaction in the presence of $R_2$-OH or the corresponding ester. Other known preparation methods may be employed.

Examples of the solvent suitable for solubilizing the polymer of the invention include a polar solvent such as dioxane, tetrahydrofuran, cresols; a chlorine-type solvent such as methylene chloride, chloroform, chlorobenzene, o-dichlorobenzene; a hydrocarbon oil such as a mineral oil, an alkylbenzene, an alkylnaphthalene, a poly-α-olefin; an ester-type oil such as dibutyl phthalate, dioctyl phthalate, dibutyl sebacate; an ether-type oil such as an oligophenylene oxide; a silicone oil; a fluorine-type oil; and mixtures thereof.

Among them, the preferred are electric insulating liquids such as hydrocarbon oils or ester-type oils in viewpoint of harmless and good insulating properties.

Hydrocarbon oils or ester-type oils are essential for solubilizing the poly(γ-glutamate) represented by the formulas (II) and (III).

The boiling point of insulating liquid is preferably 150° C. or more, more preferably 150° to 700° C. and most preferably 200° to 650° C. When the boiling point is less than 150° C., the liquid becomes too volatile. The viscosity is preferably from 1 to 500 cSt (@40° C.), more preferably 5 to 300 cSt (@40° C.).

The polymer in the electro rheological fluid of the present invention is in an amount of 0.1 to 60% by weight, preferably 0.5 to 40% by weight. The solvent in the electro theological fluid of the present invention is in an amount of 99.5% to 40% by weight, preferably 99.9 to 60% by weight. When the amount of polymer is less than 0.1% by weight the electro rheological effect is not sufficient, and inversely when the amount is more than 60% by weight, the polymer becomes hard to dissolve, and the initial viscosity of the polymer solution becomes too high. The most preferred electro rheological fluid of the invention is a fluid in which the polymer has been homogeneously dissolved, and is not necessarily the one in which the polymer shows a liquid crystal phase. Even when the polymer concentrations are in a range in which the polymer does not show a liquid crystal phase, the resulting fluid may exert a marked electro rheological effect.

The electro rheological fluids of the present invention, and the homogeneous electro theological fluids in particular, exert a good electro theological effect, and are suitable for use in damping devices such as engine mounts, shock absorbers; clutches, torque converters, break systems, bulbs, dampers, suspensions, actuators, vibrators, and ink jet printers.

EXAMPLES

The invention will be illustrated but in no way limited by the following examples.

Example 1

In 9.5 g of α-methylnaphthalene was dissolved 0.5 g of poly(L-α-amino myristic acid) having a degree of polymerization of 1800 obtained by NCA polymerization from L-α-amino myristic acid in the presence of phosgene to prepare an electro theological fluid (1). The poly(L-α-amino myristic acid) was completely dissolved in the α-methylnaphthalene.

The torque value (T) of the resulting electro rheological fluid (1) was measured by a double circular cylinder (inside diameter of cylinder Φ=16 mm, outside diameter of cylinder Φ=18 mm)-type rotational viscometer fitted with an electric field applying device at 25° C., an applied voltage of 2 kV/mm, and a shearing rate of 400 $s^{-1}$. The current value was also measured at the same time. After addition of 1% by weight of water to the foregoing electro rheological fluid (1) and maintaining it under stirring at 50° C. for 300 hrs, the torque of the resulting fluid was measured in a similar manner to determine the stability, and thereafter GPC analysis was performed on the fluid to determine the degree of cleavage of the polymer. Table 1 shows the results. The torque value (T) was calculated from the difference in torque between the two fluids after and before the application of an electric field.

Example 2

In 9.5 g of α-methylnaphthalene was dissolved 0.5 g of poly(L-α-amino lauric acid) having a degree of polymerization of 2000 obtained by NCA polymerization from L-α-amino lauric acid in the presence of phosgene to prepare an electro rheological fluid (2). The poly(L-α-amino lauric acid) was completely dissolved in the α-methylnaphthalene. The torque value (T) and the current value of the fluid (2) were measured in a similar manner to that described in Example 1. Table 1 shows the results.

Comparative Example 1

To 9.5 g of o-dichlorobenzene was added 0.5 g of poly (γ-benzyl-L-glutamate) (reagent grade)(SIGMA Chemical Co.) having a degree of polymerization of 1600 to prepare an electro rheological fluid (3). The poly(γ-benzyl-L-glutamate) was completely dissolved in the o-dichlorobenzene.

The torque value (T) and the current value of the electro rheological fluid (3) were measured in a similar manner to that of Example 1. Table 1 shows the results.

TABLE 1

Test Results for Electro rheological Effect

| | Example 1 | Example 2 | Comparative Example 1 |
|---|---|---|---|
| Electro rheological Fluid | (1) | (2) | (3) |
| Torque Value (g · cm) | 134 | 122 | 121 |
| Current Value (μA) | 31 | 38 | 5910 |
| Torque Value after Stability Test (g · cm) | 128 | 117 | 18 |
| Molecular Distribution after Stability Test (measured by GPC) | no change | no change | many low-molecular peaks |

From the data it is clear that the poly(α-amino acid)s of the present invention are more stable in the presence of water in comparison with the stability of the poly(γ-benzyl-L-glutamate) having ester groups located on side chains of the polymer structure, and the torque value does not decrease appreciably. It was also confirmed by GPC analysis that no cleavage of the polymer has taken place, indicating the good resistance to hydrolytic cleavage of the electro rheological fluid of the invention.

Example 3

A mixture of 200 ml of dichloroethane and 2 g of p-toluene sulfonic acid was refluxed at 115° C. for 4 hrs to remove water from the system. To the solution was added 4 g of poly(γ-benzyl-L-glutamate) having a molecular weight of 40,000 (SIGMA Chemical Co.) to dissolve the polymer completely, followed by addition of 20 g of dodecyl alcohol. The ester exchange reaction was carried out under refluxing of the dichloroethane for 24 hrs. After the reaction was completed, the resulting solution was added to a great amount of methanol in order to precipitate the polymer. The polymer was then recovered by filtration, washed with methanol, and dissolved again in dichloroethane. The foregoing purification was repeated three times thereby recovering 4.4 g of purified polymer (3) after drying at 80° C./2 mmHg. It was confirmed by NMR analysis that the polymer (3) is a poly(γ-benzyl-L-glutamate-co-γ-dodecyl-L-glutamate) in which 71% of benzyl groups has been displaced by dodecyl groups. In 9.5 g of α-methylnaphthalene was dissolved 0.5 g of the polymer (3) thus obtained to prepare an electro rheological fluid (4). The polymer (3) was completely dissolved in the α-methylnaphthalene.

The torque value (T) of the resulting electro rheological fluid (4) was measured by a double circular cylinder (inside diameter of cylinder Φ=16 mm, outside diameter of cylinder Φ=18 mm)-type rotational viscometer fitted with an electric field applying device at 25° C., an applied voltage of 3 kV/mm, to that a shearing rate of 400 $s^{-1}$. The current value was also measured at the same time. Table 2 shows the results. The torque value (T) was calculated from the difference in torque between the two fluids after and before the application of an electric field.

Example 4

The procedure of Example 3 was followed except that dioctyl phthalate was used in place of α-methyl-naphthalene to prepare an electro theological fluid (5). The polymer (3) was completely dissolved in the dioctyl phthalate.

The torque value (T) and the current value of the electro theological fluid (5) were measured in a similar manner to that described in Example 3.

Example 5

The procedure of Example 3 was followed except that 28.9 g of oleyl alcohol was used in place of 20 g of dodecyl alcohol to provide 4.5 g of a purified polymer (4). It was confirmed by NMR analysis that the polymer (4) is a poly(γ-benzyl-L-glutamate-co-γ-oleyl-L-glutamate) in which 59% of benzyl groups has been displaced by oleyl groups.

The procedure of Example 3 was followed except that the resulting polymer (4) was used in place of the polymer (3) in Example 3 to prepare an electro rheological fluid (6). The polymer (4) was completely dissolved in the α-methylnaphthalene.

The torque and current values of the electro theological fluid (6) were measured in a similar manner as described in Example 3. Table 2 shows the test results.

Comparative Example 2

The procedure of Example 3 was followed except that poly(γ-benzyl-L-glutamate) was used in place of the polymer (3) in Example 3, and dichloromethane was used in place of α-methylnaphthalene. The poly(γ-benzyl-L-glutamate) was completely dissolved in the dichloromethane. The torque value (T) and the current value were measured in a similar manner as described in Example 3. Table 2 shows the results.

During the measurements, the dichloromethane emitted its characteristic odor, and it was confirmed that the dichloromethane lost its weight by 30% by weight due to evaporation.

Comparative Example 3

The poly(γ-benzyl-L-glutamate) in an amount of 0.5 g which was used in Example 3 was mixed under stirring with 9.5 g of α-methylnaphthalene. A homogeneous fluid could not be obtained because the poly(γ-benzyl-L-glutamate) was little soluble in the α-methylnaphthalene.

TABLE 2

| | Electro rheological Fluid | Torque Value (g · cm) | Current Value (μA) |
|---|---|---|---|
| Example 3 | (4) | 165 | 47 |
| Example 4 | (5) | 132 | 56 |

TABLE 2-continued

| | Electro rheological Fluid | Torque Value (g · cm) | Current Value (μA) |
|---|---|---|---|
| Example 5 | (6) | 151 | 53 |
| Comparative Example 2 | (7) | (118)[1)] | (6890)[1)] |

Note [1)]: Measured at an applied voltage of 2 kV/mm. When the voltage was over 2 kV/mm, current was short-circuited.

As is evident from the results in these examples, the poly(γ-glutamate) of the present invention is soluble in a hydrocarbon oil or an ester oil, and the resulting electro rheological fluid has a high torque value and better insulating properties in comparison to the corresponding fluid obtained by using a poly(γ-benzyl-L-glutamate) and a chlorine-type solvent. In addition, as the fluid is homogeneous, the problems associated with the precipitation of dispersed particles may be circumvented. The electro rheological fluids of the present invention, and the homogeneous electro rheological fluids of the invention in particular exert a Good electro rheological effect, and are suitable for use in damping devices such as engine mounts, shock absorbers; clutches, torque converters, break systems, power steerings, bulbs, dampers, suspension, actuators, vibrators, and ink jet printers.

What is claimed is:

1. An electro rheological fluid comprising 0.1 to 60% by weight of a poly(α-amino acid) represented by the following formula (I):

$$-(NH-\underset{\displaystyle R}{\underset{|}{CH}}-CO)_m- \qquad (I)$$

wherein R has from 1 to 30 carbon atoms and is an alkyl, benzyl, butylbenzyl, aryl, cycloalkyl, or mixed groups thereof, and m is a degree of polymerization from 5 to 10,000 and 40 to 99.9% by weight of an electrically insulating liquid solvent therefor.

2. An electro rheological fluid claimed in claim 1 wherein said electric insulating liquid is selected from the group consisting of hydrocarbon oils, ester oils, ether oils, silicone oils, fluorine oils, and mixtures thereof.

3. An electro rheological fluid claimed in claim 1, wherein said fluid has a viscosity of 1 to 500 cSt at 40° C. and said electrically insulating liquid has a boiling point of at least 150° C.

4. An electro rheological fluid claimed in claim 3, wherein the viscosity is 5 to 300 cSt and the boiling point is up to 700° C.

5. An electro rheological fluid claimed in claim 4, in which the boiling point is 200° to 650° C., m is a degree of polymerization of 10 to 5,000 and R has 6 to 16 carbon atoms.

6. An electro rheological fluid claimed in claim 5, in which R is octyl, decyl, dodecyl, tetradecyl or hexadecyl.

7. An electro rheological fluid claimed in claim 1, in which the poly(α-amino acid) is poly(L-α-amino myristic acid) or poly(L-α-amino-lauric acid) and the electric insulating fluid is methyl naphthalene or dioctyl phthalate.

8. An electro rheological fluid comprising 60 to 99.5% by weight of an electric insulating liquid and 0.5 to 40% by weight of a poly (γ-glutamate) homopolymer represented by the following formula III or copolymer represented by the following formulas (II) and (III):

$$-(NH-\underset{\displaystyle C_2H_4-COO-R_1}{\underset{|}{CH}}-CO)_m- \qquad (II)$$

$$-(NH-\underset{\displaystyle C_2H_4-COO-R_2}{\underset{|}{CH}}-CO)_n- \qquad (III)$$

wherein $R_1$ has from 1 to 7 carbon atoms and is an alkyl, aralkyl, aryl, cycloalkyl, or mixed groups thereof, $R_2$ has from 8 to 30 carbon atoms and is an alkyl, aralkyl, aryl, cycloalkyl, or mixed groups thereof, and wherein the ratio n/m in the copolymer is from 10/90 up to 100/0 and m is not 0.

9. An electro rheological fluid claimed in claim 8 wherein said electric insulating liquid is selected from the group consisting of hydrocarbon oils, ester oils, ether oils, silicone oils, fluorine oils, and mixtures thereof.

10. An electro rheological fluid claimed in claim 9, wherein said fluid has a viscosity of 1 to 500 cSt at 40° C. and said electrically insulating liquid has a boiling point of at least 150° C.

11. An electro rheological fluid claimed in claim 10, wherein the viscosity is 5 to 300 cSt, the boiling point is up to 700° C., $R_1$ is methyl or benzyl and $R_2$ is octyl, decyl, dodecyl, oleyl or butylhexyl.

12. An electro rheological fluid claimed in claim 11, in which the boiling point is 200° to 650° C., $R_2$ is dodecyl or oleyl and the ratio n/m is 80/20 to 30/70.

13. An electro rheological fluid claimed in claim 12, in which $R_1$ is benzyl and the electric insulating liquid is methyl naphthalene or diocyl phthalate.

14. An electro rheological fluid claimed in claim 13, in which the copolymer is poly(γ-benzyl-L-glutamate-co-γ-dodecyl-L-glutamate) in which the ratio of benzyl to dodecyl groups is 29:71 and the electric insulating liquid is methyl naphthalene.

* * * * *